US011839255B2

(12) United States Patent
Borbone et al.

(10) Patent No.: US 11,839,255 B2
(45) Date of Patent: Dec. 12, 2023

(54) HELMET RETENTION SYSTEM WITH ADJUSTMENT MECHANISM

(71) Applicant: Avon Rubber P.L.C., Melksham (GB)

(72) Inventors: Vincent Borbone, Hampstead, NH (US); Matthew Graves, Salem, NH (US)

(73) Assignee: Avon Protection Ceradyne LLC, Irvine, CA (US)

( * ) Notice: Subject to any disclaimer, the term of this patent is extended or adjusted under 35 U.S.C. 154(b) by 416 days.

(21) Appl. No.: 16/983,963

(22) Filed: Aug. 3, 2020

(65) Prior Publication Data

US 2021/0037907 A1 Feb. 11, 2021

Related U.S. Application Data

(60) Provisional application No. 62/882,966, filed on Aug. 5, 2019.

(51) Int. Cl.

| | |
|---|---|
| ***A42B 3/14*** | (2006.01) |
| ***A42B 3/08*** | (2006.01) |
| ***A42B 3/32*** | (2006.01) |
| ***F41H 1/04*** | (2006.01) |

(52) U.S. Cl.

CPC ..... *A42B 3/145* (2013.01); *A42B 3/08* (2013.01); *A42B 3/324* (2013.01); *F41H 1/04* (2013.01)

(58) Field of Classification Search

CPC ..... A42B 3/145; A42B 3/08; A42B 3/324

See application file for complete search history.

(56) References Cited

U.S. PATENT DOCUMENTS

| | | | | |
|---|---|---|---|---|
| 2,511,234 | A * | 6/1950 | Anderson | A42B 3/145 403/107 |
| 2,926,406 | A * | 3/1960 | Edwards | A42B 3/145 2/418 |
| 6,314,588 | B1 * | 11/2001 | Fang | A42B 3/145 2/418 |
| 7,174,575 | B1 * | 2/2007 | Scherer | A42B 3/145 2/418 |
| 8,370,967 | B2 | 2/2013 | Chen | |
| 9,161,588 | B2 | 10/2015 | Chen | |
| 2007/0266481 | A1 | 11/2007 | Alexander et al. | |
| 2008/0184451 | A1 | 8/2008 | Lemke et al. | |
| 2011/0088148 | A1 * | 4/2011 | Chen | A42B 3/145 2/418 |
| 2011/0113519 | A1 | 5/2011 | Gendron et al. | |
| 2013/0205478 | A1 | 8/2013 | Pfanner et al. | |
| 2014/0096310 | A1 | 4/2014 | Szalkowski et al. | |
| 2015/0059064 | A1 | 3/2015 | Klotz et al. | |
| 2018/0092424 | A1 | 4/2018 | Hall et al. | |
| 2021/0259344 | A1 * | 8/2021 | Manni | A42B 1/22 |

FOREIGN PATENT DOCUMENTS

WO 9846097 A1 10/1998

OTHER PUBLICATIONS

European Patent Office, Extended European Search Report re Corresponding Application No. 20187849.3-1017, dated Jan. 15, 2021, 8 pages, Munich, Germany.

* cited by examiner

*Primary Examiner* — Tajash D Patel
(74) *Attorney, Agent, or Firm* — McGarry Bair PC

(57) ABSTRACT

Helmet retention systems including a dial adjustment mechanism for adjusting the effective length of a head band are described. The dial adjustment mechanisms include a separator to separate portions of the head band during adjustment.

18 Claims, 5 Drawing Sheets

HELMET RETENTION SYSTEM WITH ADJUSTMENT MECHANISM

CROSS REFERENCE TO RELATED APPLICATIONS

This application claims the benefit of U.S. application No. 62/882,966 filed Aug. 5, 2019, the entirety of which is incorporated herein.

FIELD

The present disclosure relates to a helmet retention system including a head band and a a dial adjustment mechanism with a separator to separate portions of the head band.

SUMMARY

Briefly, in one aspect, the present disclosure provides a helmet retention system comprising a dial adjustment system. The dial adjustment mechanism comprises a housing having a first edge and a second edge, and a dial rotationally connected to the housing; a head band having a first band end, a second band end, and an effective length, wherein the effective length of the head band comprises a first portion of the head band located outside the housing extending from the first edge of the housing to the second edge of the housing. The mechanism also includes a separator located between the first band end and the effective length of the head band.

In another aspect, the present disclosure provides a helmet comprising such helmet retention systems.

The above summary of the present disclosure is not intended to describe each embodiment of the present invention. The details of one or more embodiments of the invention are also set forth in the description below. Other features, objects, and advantages of the invention will be apparent from the description and from the claims.

DETAILED DESCRIPTION

Helmets are used in a wide variety of applications and offer a broad range of protection. Exemplary applications for helmets include sports, cycling, industrial, and ballistic protection helmets. To provide the desired level of protection, it is often desirable to have a firm fit to the wearer's head. The fit can be provided, in part, by pads or webbing inside the helmet. However, most helmets include a retention system including straps (e.g., chin straps) and bands (e.g., a head band) to insure a secure and firm fit.

Typically, the desired fit will hold the helmet securely in place during use and minimize or eliminate undesired movement of the helmet relative the wearer's head. However, the tightness of such a fit can make putting on and taking off the helmet difficult. In addition, the pressure needed for a secure fit can create discomfort if applied for extended periods of time. These concerns have been addressed by including an adjustment mechanism that can be used to increase or decrease the securement features while the helmet is in place. For example, the features may be loosened prior to putting on the helmet, and only tightened after the helmet is in place. Similarly, the features can be loosened again before removing the helmet. Such adjustment mechanisms may also allow one size of helmet to be used over a range of head sizes, as the fit can be adjusted to accommodate variations in head sizes and shapes.

In some applications, adjustment mechanisms may be used to reduce the pressure at times when less protection is needed, e.g., between plays for sports helmets, while resting for cycling helmets, or when in a secure location for ballistic helmets. The mechanism can then be used to increase the pressure only when protection is required. In such situations, simple, one-handed adjustment of the mechanism can be beneficial.

Figure 1:
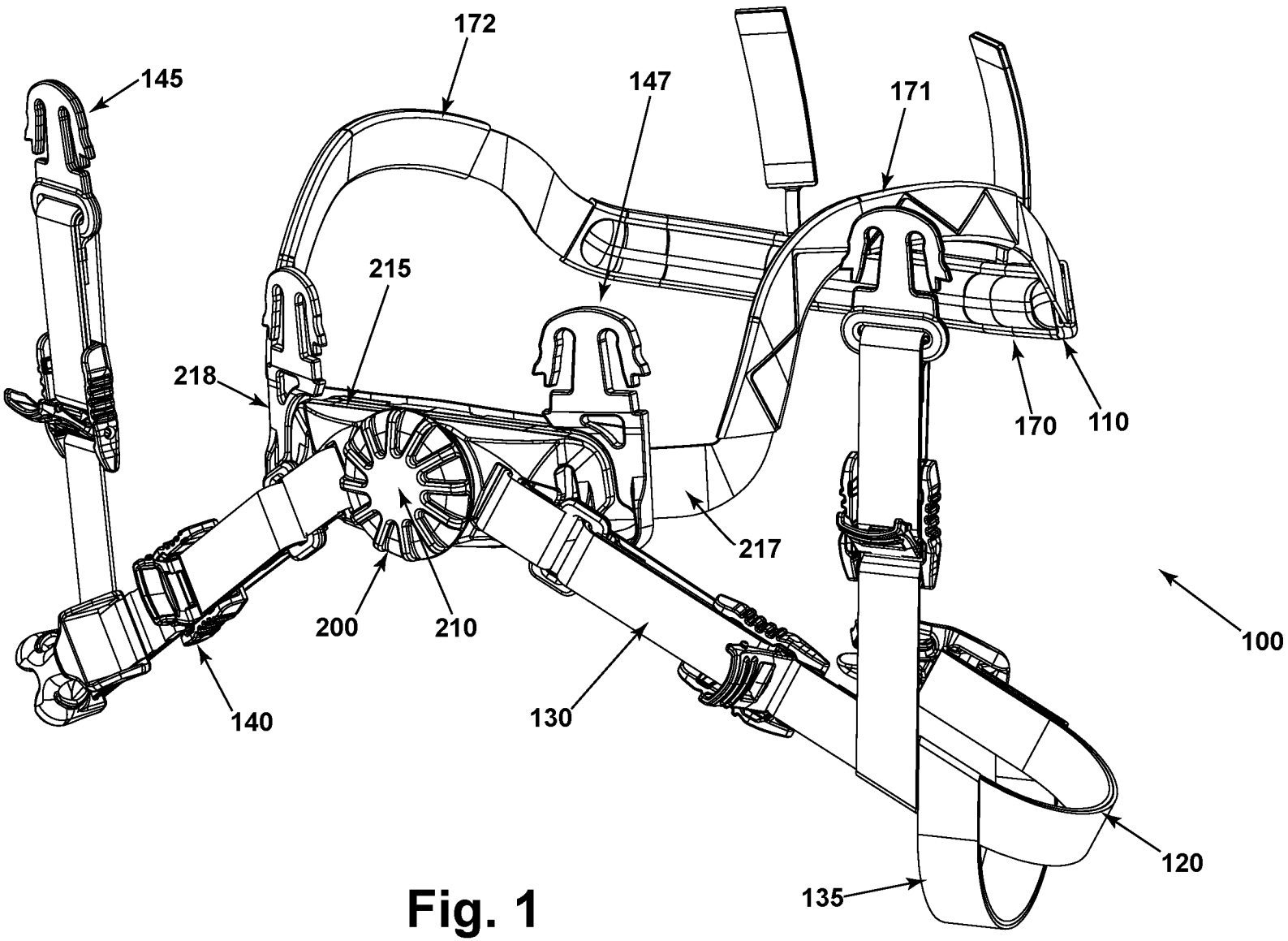
FIG. 1 illustrates a helmet retention system including a dial adjustment mechanism.

An exemplary helmet retention system is shown in FIG. 1. Retention system 100 includes dial adjustment mechanism 200 connected to head band 110. Webbing 120 may include various straps 130 (e.g., chin strap 135), buckles 140, clips 145, and fasteners 147, e.g., repositionable fasteners. For example, many helmet retention systems include various clips and fasteners to secure the helmet retention system to the helmet, and various buckles and straps to secure the helmet to the wearer's head. However, the presence, number and location of such elements can be selected for the intended purpose and to complement the overall helmet design.

Generally, head band 110 includes forehead portion 170 positioned to rest against the wearer's forehead during use. In some embodiments, forehead pad 150 is attached to the forehead portion of the head band. The head band includes first side portion 171 extending between forehead portion 170 and first edge 217 of the housing, and second side portion 172 extending between the forehead portion and second edge 218 of the housing. In some embodiments, one or more side pads 151 may be attached to the first side portion, the second side portion or both. In some embodiments, the first and second side portions may be shaped such that they will be positioned above the wearer's ears in use.

Dial adjustment mechanism 200 includes dial 210 operably connected to opposite band ends of head band 110 within housing 215. As discussed below, dial 210 is used to move the band ends (not shown) in opposite directions thereby increasing or decreasing the effective length of head band 110, where the "effective length of the head band" includes the portion of the head band extending outside the housing from first edge 217 to second edge 218 of housing 215.

Figure 2:
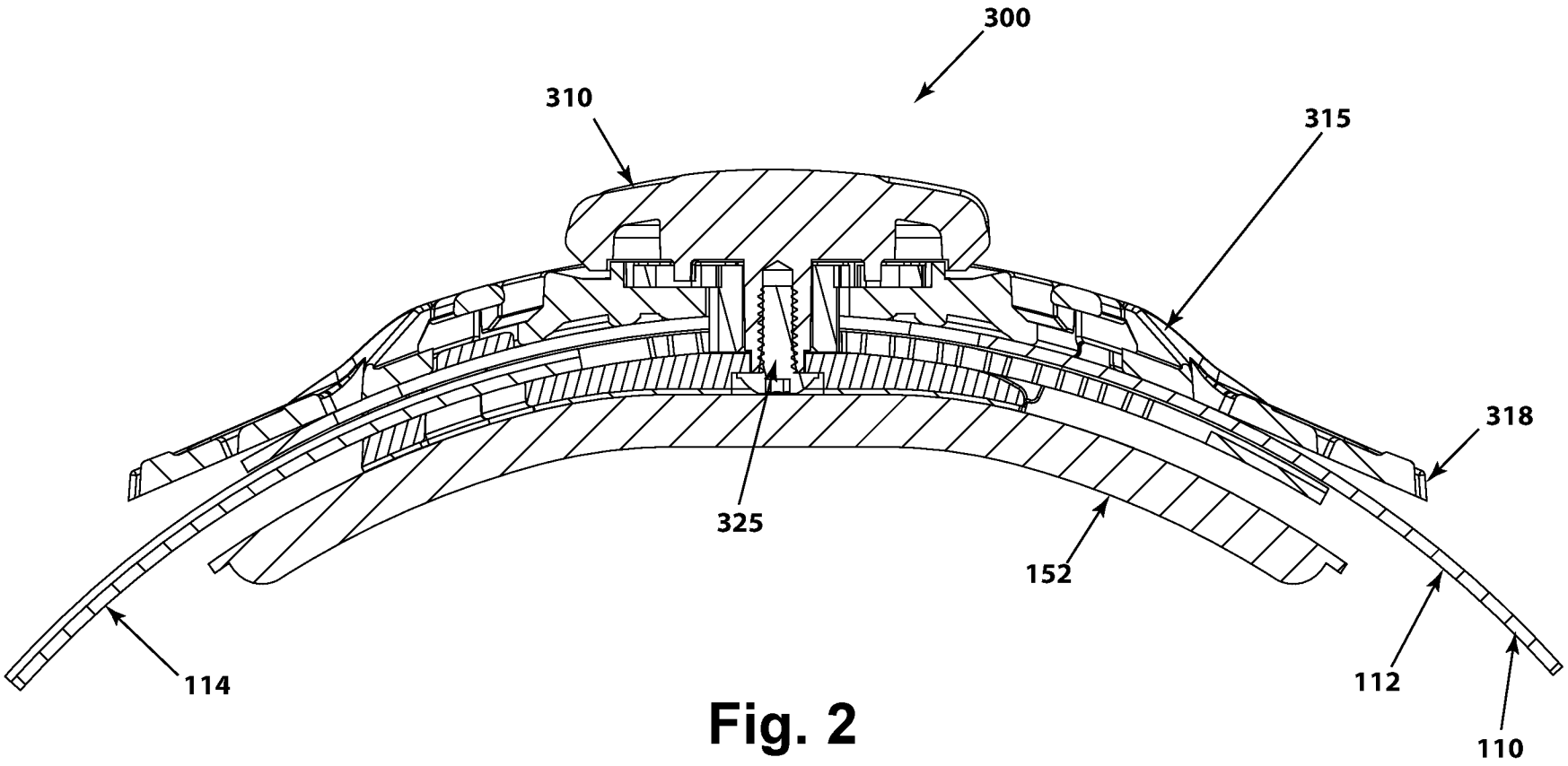
FIG. 2 is a cross section of a dial adjustment mechanism shown as part of a helmet retention system.
Figure 3:
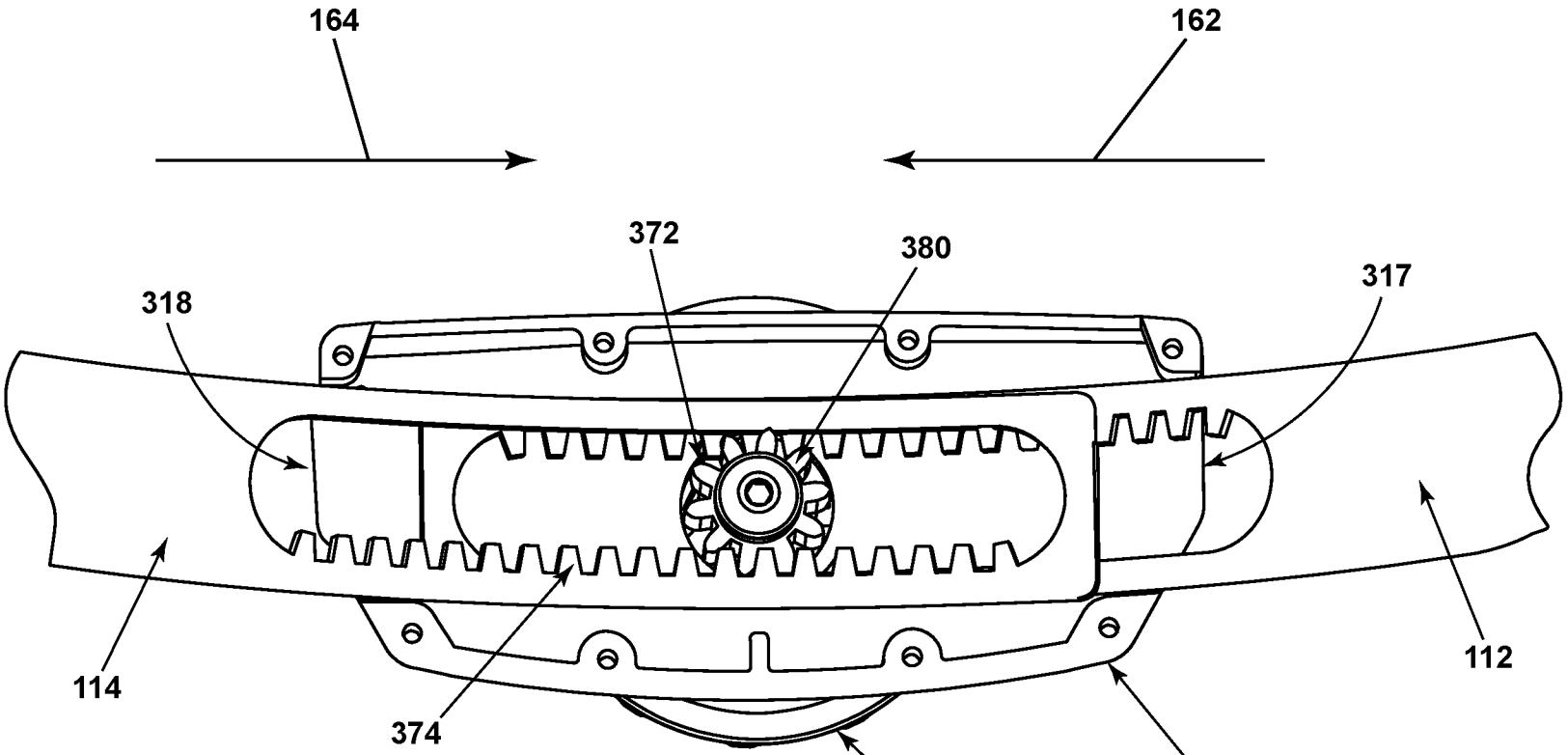
FIG. 3 is an expanded view of a portion of the dial adjustment mechanism of FIG. 2

Features of an exemplary dial adjustment mechanism 300 are shown in FIGS. 2 and 3. In FIG. 2, dial adjustment mechanism 300 is shown as part of a helmet retention system including head band 110. Details of one way to operable connect first band end 112 and second band end 114 of head band 110 to dial adjustment mechanism 300 are shown in FIG. 3.

Dial adjustment mechanism 300 includes dial 310 rotatably connected to housing 315 via fastener 325. As used herein, "rotatably connected" means the dial is secured to the housing but remains rotatable. Although shown as a screw, fastener 325 may be any known fastener allowing rotational movement of dial 310 relative to housing 315 after it is connected. Optional nape pad 152 may cover all or a portion of housing 315 to aid in the comfort and desired fit.

Dial 310 is operably connected to first band end 112 and second band end 114 of head band 110. As used herein, "operably connected" means the dial is directly or indirectly connected to the band ends such that rotation of the dial results in movement of the band ends such that the effective length of the head band is adjusted.

In some embodiments, dial 310 is connected to toothed wheel 380. In such embodiments, dial 310 is operably connected the band ends via toothed wheel 380 that engages corresponding teeth on the band ends. For example, as shown in FIG. 3, toothed wheel 380 can engage teeth 374 of second band end 114 as they pass along one side of toothed wheel 380. Similarly, the toothed wheel can engage teeth 372 of first band end 112 as they pass over the opposite side of toothed wheel 380.

As dial 310 is rotated, toothed wheel 380 rotates moving band ends 112 and 114 of head band 110 in opposite directions. For example, as dial 310 rotates toothed wheel 380 in a first direction (e.g., counterclockwise in FIG. 3), the engagement of the toothed wheel with teeth 374 of second band end 114 will move second band end 114 in the direction indicated by arrow 164. Simultaneously, the engagement of the toothed wheel with teeth 372 of first band end 112 will move first band end 112 in the opposite direction as indicated by arrow 162. As a result, the effective length of head band 110 will become shorter, tightening and securing the helmet retention system (and its associated helmet) to the wearer's head. In such embodiments, when dial 310 rotates toothed wheel 380 in the opposite direction (i.e., clockwise in FIG. 3), band ends 112 and 114 will move in the directions opposite arrows 162 and 164, respectively, and the effective length of head band 110 will increase, relieving pressure from the wearer's head. Of course, the dial adjustment mechanism could also be configured such that rotating the dial in the clockwise direction tightens the retention system, while rotation in the counterclockwise direction loosens the retention system.

As described previously, the effective length of the head band includes the portion of head band 100 outside of housing 315 extending from first edge 317 to second edge 318 of the housing. As shown in FIG. 3, the effective length of head band 110 also includes a portion of the head band located inside housing 315. That is, the effective length of head band 110 also includes length L1 of first band end 112 extending from first edge 317 of housing 315 to toothed wheel 380; and length L2 of second band end 114 extending from second edge 318 of housing 315 to toothed wheel 380.

Referring to FIG. 2, as first band end 112 of head band 110 passes from toothed wheel 380, toward and beyond edge 318 of housing 315, it passes between the head band 110 and the interior of the helmet retention system. As first band end 112 moves, it is pressed into frictional contact with the effective length of head band 110. As the head band is tightened, first band end 112 will be pressed between head band 110 and the wearer's head or other interior portions of the helmet thereby increasing the friction.

This creates two problems. First, the frictional resistance may become so high that further adjustment can become difficult or impossible as the dial cannot generate enough force to overcome such pressure-enhanced friction. This can result in too loose a fit and increased risk of undesired motion of the helmet. This problem is exacerbated when a larger helmet needs to be adjusted to fit a smaller head size, as greater lengths of the first end are in frictional engagement with the effective length head band. Second, in cases where the first band end is pressed between the head band and the wearer's head, the band end can rub against the skin while under pressure creating discomfort during the adjustment.

Note that these problems do not occur at second band end 114, as the second band end is located outside the effective length of head band 110, i.e., on the side opposite the interior of the helmet and the wearer's head. This allows second band end 114 to move away from head band 110 as the second band end moves past toothed wheel 380 and beyond first edge 317 of housing 315, minimizing or eliminating friction.

Figure 4:
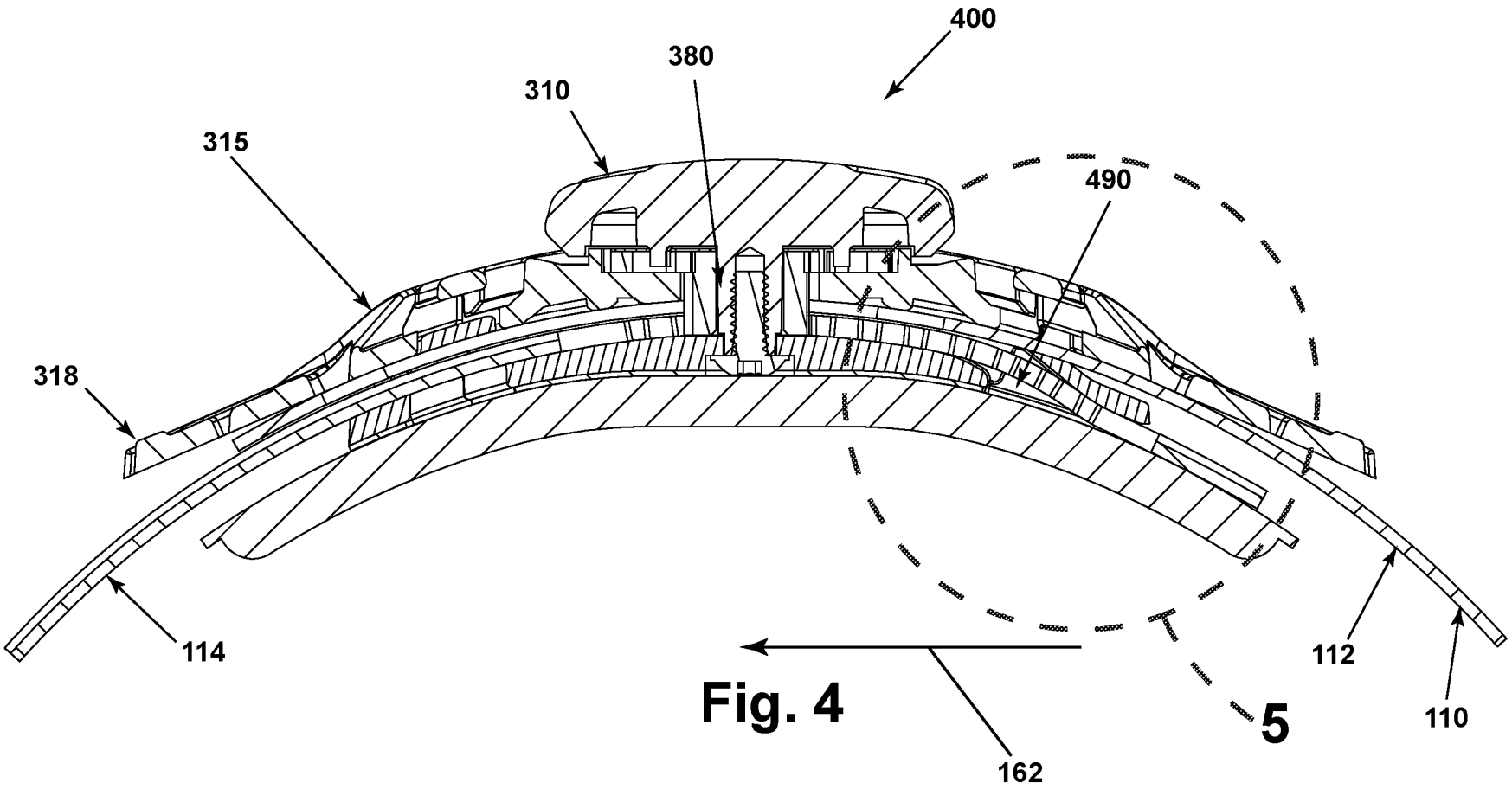
FIG. 4 is a cross section of a dial adjustment mechanism including a separator according to some embodiments of the present disclosure.

A cross section of exemplary dial adjustment mechanism 400 is shown in FIG. 4. Dial adjustment mechanism 400 is similar to dial adjustment mechanism 400, where like numbers refer to like parts. Dial adjustment mechanism 400 further includes exemplary separator 490 according to some embodiments of the present disclosure. As dial 310 of dial adjustment mechanism 400 is rotated, first band end 112 is moved in the direction of arrow 162. As first band end 112 moves away from toothed wheel 380 and toward second edge 318 of housing 315 it encounters separator 490, which directs first band end 112 away from the effective length of head band 110. By separating first band end 112 from head band 110 they are no longer in frictional engagement and the force required to move the first end is substantially reduced. In some embodiments, first band end 112 will come back into contact with the effective length of head band 110 some distance away from housing 315 creating some frictional engagement. However, the area of contact will still be significantly reduced resulting in easier adjustment and less discomfort.

In some embodiments, separator 490 is integral to housing 315. In some embodiments, a separator may be attached to the housing, e.g., to retrofit existing helmet retention systems. Generally, the separator is located at or near the edge of the housing beyond which the first band end extends. Such a location can maximize the downstream distance over which the first band end remains lifted away from the head band.

Figure 5:
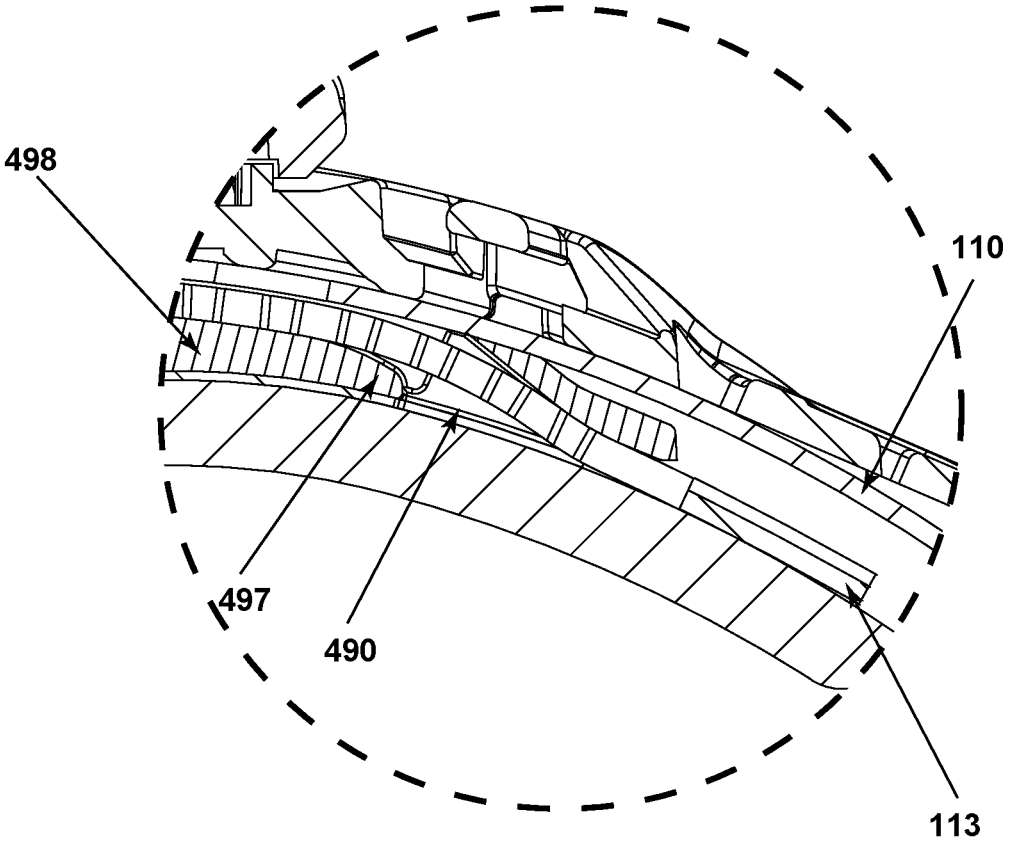
FIG. 5 illustrates an exemplary separator according to some embodiments of the present disclosure.

Generally, the shape of the separator is not critical so long as it functions to move the first band end away the head band. In some embodiments, it will have a general ramp-shape, as depicted for separator 490 of FIG. 5. In such embodiments, the thinner portion 497 of the separator faces inward toward the dial such that it easily slides beneath leading tip 113 of first band end 112. As first band end 112 continues along the ramp formed by separator 490, it is moved further away from head band 110. The thicker portion 498 of separator 490 may be shaped to provide a smooth transition and ensure the structural integrity of the separator.

Generally, any known materials may be used to construct the helmet retentions systems of the disclosure. Such materials and parts are readily available to one of ordinary skill in the art.

Generally, the hand band made comprise any suitable material. However, it is preferable to construct the head band to minimize or eliminate stretching as stretching can result in a loosening of the fit over time and can make adjustment of the effective length of the headband more difficult. In some embodiments, the helmet band comprises a polymeric material. In some embodiments, the headband will exhibit less than 5% elongation, e.g., less than 1% elongation, or even less than 0.2% elongation when the effective length of the head band is adjusted.

Various modifications and alterations of this invention will become apparent to those skilled in the art without departing from the scope and spirit of this invention.

What is claimed is:

1. A helmet retention system comprising:

a dial adjustment mechanism including a housing having a first edge and a second edge, and a dial rotationally connected to the housing;

a head band having a first band end, a second band end, and an effective length, wherein the effective length of the head band comprises a first portion of the head band located outside the housing extending from the first edge of the housing to the second edge of the housing;

a separator located between the first band end and the effective length of the head band; and a nape pad covering at least a portion of the housing and one or more pads attached to the effective length of the head band;

wherein the dial is operably connected to the first band end and the second band end such that rotation of the dial would cause the first band end and the second band end to move in opposite directions thereby adjusting the effective length of the head band.

2. The helmet retention system of claim 1, further comprising toothed wheel connected to the dial, wherein first band end comprises first teeth engaged with a first side of the toothed wheel, and the second band end comprises second teeth engaged with a second side of the toothed wheel, wherein the separator is located between the toothed wheel and the second edge of the housing.

3. The helmet retention system of claim 2, wherein the effective length of the head band further comprises a second portion of the head band located inside the housing comprising a first length of the first band end extending from the toothed wheel to the first edge of the housing; and second length of the second band end extending from the toothed wheel to the second edge of the housing.

4. The helmet retention system according to claim 1, wherein the separator comprises a first edge facing the dial and a second edge facing the second edge of the housing, wherein the thickness of the first edge is less than the thickness of the second edge.

5. The helmet retention system according to claim 4, wherein rotation of the dial causes the effective length of the head band to be adjusted.

6. The helmet retention system according to claim 1 further comprising webbing comprising at least one strap.

7. The helmet retention system according to claim 1 further comprising one or more clips for connecting the helmet retention system to a helmet.

8. The helmet retention system according to claim 1 wherein the effective length of the head band comprises a forehead portion, a first side portion located between the forehead portion and the first edge of the housing, and a second side portion located between the forehead portion and the second edge of the housing.

9. The helmet retention system of claim 8 further comprising forehead pad attached to the forehead portion of the head band.

10. The helmet retention system of claim 8 comprising one or more side pads attached to at least one of the first side portion and the second side portion.

11. A helmet comprising the helmet retention system according to claim 1.

12. The helmet of claim 11 wherein the helmet is a ballistic helmet.

13. The helmet of claim 11 further comprising toothed wheel connected to the dial, wherein the first band end comprises first teeth engaged with a first side of the toothed wheel, and the second band end comprises second teeth engaged with a second side of the toothed wheel, wherein the separator is located between the toothed wheel and the second edge of the housing.

14. The helmet of claim 11 wherein the separator comprises a first edge facing the dial and a second edge facing the second edge of the housing, wherein the thickness of the first edge is less than the thickness of the second edge.

15. A helmet retention system comprising:

a dial adjustment mechanism including a housing having a first edge and a second edge, and a dial rotationally connected to the housing;

a head band having a first band end, a second band end, and an effective length, wherein the effective length of the head band comprises a first portion of the head band located outside the housing extending from the first edge of the housing to the second edge of the housing;

a separator located between the first band end and the effective length of the head band; and a toothed wheel connected to the dial, wherein first band end comprises first teeth engaged with a first side of the toothed wheel, and the second band end comprises second teeth engaged with a second side of the toothed wheel, wherein the separator is located between the toothed wheel and the second edge of the housing;

wherein the dial is operably connected to the first band end and the second band end such that rotation of the dial would cause the first band end and the second band end to move in opposite directions thereby adjusting the effective length of the head band.

16. The helmet retention system of claim 15 wherein the separator is located between the toothed wheel and the second edge of the housing.

17. A helmet retention system comprising:

a dial adjustment mechanism comprising:

a housing having a first edge and a second edge, and a dial rotationally connected to the housing;

a head band having a first band end, a second band end, and an effective length, wherein the effective length of the head band comprises a first portion of the head band located outside the housing extending from the first edge of the housing to the second edge of the housing; and a separator located between the first band end and the effective length of the head band, wherein the separator comprises a first separator edge facing the dial and a second separator edge facing the second edge of the housing, wherein the thickness of the first edge is less than the thickness of the second edge;

wherein the dial is operably connected to the first band end and the second band end such that rotation of the dial would cause the first band end and the second band end to move in opposite directions thereby adjusting the effective length of the head band.

18. The helmet retention system of claim 17 further comprising a toothed wheel connected to the dial, wherein the first band end comprises first teeth engaged with a first side of the toothed wheel, and the second band end comprises second teeth engaged with a second side of the toothed wheel, wherein the separator is located between the toothed wheel and the second edge of the housing.

* * * * *